US010232964B2

(12) United States Patent
Kitago

(10) Patent No.: US 10,232,964 B2
(45) Date of Patent: Mar. 19, 2019

(54) MANUAL BUNDLING TOOL

(75) Inventor: Toru Kitago, Himeji (JP)

(73) Assignee: HELLERMANNTYTON CO., LTD. (JP)

( * ) Notice: Subject to any disclaimer, the term of this patent is extended or adjusted under 35 U.S.C. 154(b) by 443 days.

(21) Appl. No.: 14/408,718

(22) PCT Filed: Aug. 9, 2012

(86) PCT No.: PCT/JP2012/070371
§ 371 (c)(1),
(2), (4) Date: Dec. 17, 2014

(87) PCT Pub. No.: WO2014/024296
PCT Pub. Date: Feb. 13, 2014

(65) Prior Publication Data

US 2015/0151862 A1 Jun. 4, 2015

(51) Int. Cl.
*B65B 13/30* (2006.01)
*B65B 13/02* (2006.01)
*B65B 13/34* (2006.01)

(52) U.S. Cl.
CPC ..... *B65B 13/305* (2013.01); *B65B 13/027* (2013.01); *B65B 13/345* (2013.01)

(58) Field of Classification Search
CPC ..... B65B 13/34; B65B 13/345; B65B 13/025; B65B 13/027; B65B 13/30; B65B 13/305; B25B 25/00
See application file for complete search history.

(56) References Cited

U.S. PATENT DOCUMENTS 5,088,395 A * 2/1992 Schlottke ..... B65B 13/24 100/30
5,123,456 A * 6/1992 Jansen ..... B25B 25/005 140/123.6

(Continued)

FOREIGN PATENT DOCUMENTS

JP 2-504253 12/1990
JP 2006-240695 9/2006

(Continued)

OTHER PUBLICATIONS

International Search Report dated Nov. 6, 2012, Application No. PCT/JP2012/070371, 2 pages.

*Primary Examiner* — Jimmy T Nguyen
*Assistant Examiner* — Gregory Swiatocha
(74) *Attorney, Agent, or Firm* — Robert J. Myers

(57) ABSTRACT

A manual binding tool including a mechanism for applying plastic deformation to a tie portion located in a head portion to forcibly cause tie portions to engage with each other. A manual binding tool has a tie holding portion that receives and supports a head portion, a tightening mechanism that pulls a projection tie portion that projects through the head portion, a return preventing mechanism that blocks a return movement of the projection tie portion with respect to the head portion that is supported by the tie holding portion, and a pushing mechanism that, in a state where the head portion is supported by the tie holding portion, pushes and deforms a passed tie portion located in the head portion, and that causes the deformed portion to be engaged into an engagement hole of a root tie portion on which the head portion is previously surroundingly held.

5 Claims, 15 Drawing Sheets

(56) References Cited

U.S. PATENT DOCUMENTS

| | | | | |
|---|---|---|---|---|
| 5,743,310 | A * | 4/1998 | Moran | B65B 13/025 140/123.6 |
| 7,650,680 | B2 | 1/2010 | Stillings et al. | |
| 2006/0288539 | A1 | 12/2006 | Caveney et al. | |
| 2008/0209692 | A1 * | 9/2008 | Caveney | B65B 13/027 24/20 R |

FOREIGN PATENT DOCUMENTS

| | | |
|---|---|---|
| JP | 2011-011799 | 1/2011 |
| JP | 2012-001229 | 1/2012 |

* cited by examiner

MANUAL BUNDLING TOOL

TECHNICAL FIELD

The present invention relates to a manual binding tool for a binding tie (binding band), and more particularly to a manual binding tool which is suitably used for a binding work using a metal-made binding tie.

BACKGROUND ART

As a binding tie (binding band), as disclosed in Patent Literature 1, known is a synthetic resin-made binding tie in which a slip-off prevention function for a tie portion is provided in a head portion by ratchet teeth and the like. A synthetic resin-made binding tie is inexpensive and easy to handle, and often used as binding means for a relatively light load such as a wire harness.

In the binding tie, a to-be-bound object can be bound by simply pulling the tie portion with the fingers, and, in the case where a large tightening force is required, firm binding is surely enabled by using a binding toll.

Moreover, a metal-made binding tie (metal tie) is used in binding in the case where further strength is necessary, such as the case where a plurality of metal pipes are to be bound. As in a metal-made binding tie disclosed in Patent Literature 2, for example, a binding tie in which the ball-lock type is employed in order to prevent a tie portion from slipping off from a head portion is known.

The binding tie is self-locked by a ball which is moved by a phenomenon in which the tie portion tries to be moved in the direction along which the tie portion is pulled out from the head portion, by reaction of a tightening force or the like. The binding tie is excellent because, in the case where a large pull out force due to a strong tightening force acts, a countermeasure can be taken in which the ball (3) causes the tie body (2B) to be recessedly deformed so as to enter a recess (12) of a root tie portion that is previously passed through the head portion.

However, in the structure where the slip-off prevention is performed by the self-lock function due to the ball to keep the tightening force, in the case where strong vibration or shock acts on a to-be-bound object or the binding tie itself, for example, there is a possibility that the ball is instantaneously moved and the tie portion is slightly moved in the slip-off direction, and it is feared that the structure becomes functionally unstable. Also in the case where recess deformation is formed by the ball, also the recessed engagement portion itself is deformed by the self-lock function due to the ball, and hence there is room for improvement in the viewpoint of whether the pressing is so strong that sure engagement is realized or not.

In the powered or manual bundling tool (apparatus) disclosed in Patent Literature 3, a technique is disclosed in which, as shown in FIGS. 15 to 17 and the like of the literature, a forced pushing drive of a punch (100) having a hemispherical end portion (202) causes a band (136) positioned in a head portion to be forcibly push deformed, and the deformed portion is pushed into an opening (30) of the secured end (144) to be engaged therewith.

Namely, a metal band is surely plastically deformed by forced punching caused by a machine, to cause bands to engage with each other, thereby obtaining a slip-off prevention function which is more assured as compared with an engagement due to the self-lock function.

PRIOR ART LITERATURE

Patent Literatures

Patent Literature 1: Japanese Patent Application Laid-Open No. 2012-001229

Patent Literature 2: Japanese Patent Application Laid-Open No. 2011-011799

Patent Literature 3: U.S. Pat. No. 7,650,680

Problem to be Solved by the Invention

Also in the bundling apparatus of Patent Literature 3 in which the band is plastically deformed by using a machine to perform forced engagement, however, it seems that there is a problem. Referring to FIGS. 15 to 17 and the like of Patent Literature 3, namely, a manner in which the band (136) is forcibly push deformed by the punch (100) to enter the opening (30) is described, but, in this case, only a free end (154) which is introduced in an apparatus in the band is supported, and a buckle (12) corresponding to the head portion is not supported.

Even when the punch (100) is strongly pushed out, therefore, the buckle (12) which receives the force is nothing in a state where it relies on only the supporting force of the free end (154), or is in a so-called cantilever state. Consequently, the transmission efficiency of the force causing plastic deformation is very low. As a result, it is unstable whether plastic deformation of the band due to the above is formed into a desired state or not.

In FIGS. 15 to 17 and the like of Patent Literature 3, in fact, the buckle (12) in the attitude which is gently inclined upward to the left in FIG. 15 is gradually changed to the attitude which is inclined downward to the left in the sequence of FIGS. 16 and 17, in accordance with the downward movement of the punch (100). Obviously, the structure has irrationality that the force of the punching escapes.

In view of the above-discussed circumstances, it is an object of the invention to provide a manual binding tool in which a mechanism for applying plastic deformation to a tie portion located in a head portion to forcibly cause tie portions to engage with each other is further improved, and which is therefore improved so that a disadvantage that a pushing force acting on the head portion escapes is eliminated, plastic deformation can be performed in a firmly supported state, and slip-off prevention can be conducted more surely.

Means for Solving the Problem

The invention of claim 1 provides a manual binding tool wherein the tool has:

a tie holding portion g which receives and supports a head portion 5;

a tightening mechanism a which pulls a projection tie portion 4*a* that projects through the head portion 5 that is supported by the tie holding portion g, with respect to the head portion 5;

a return preventing mechanism j which blocks a return movement of the projection tie portion 4*a* with respect to the head portion 5 that is supported by the tie holding portion g; and a pushing mechanism h which, in a state where the head portion 5 is supported by the tie holding portion g, pushes and deforms a passed tie portion 4*c* located in the head portion 5, and which causes the deformed portion 4*b* to be engaged into an engagement hole 10 of a root tie portion 4*d* on which the head portion 5 is previously surroundingly held.

The invention of claim 2 is characterized in that, in the manual binding tool of claim 1, the pushing mechanism h has a punch body 28 which is projectively and retractively movable, and which is used for pushing and deforming the projection tie portion 4*a*, and, in a state where the head portion 5 is supported by the tie holding portion g, the tie holding portion g and the punch body 28 are placed in a linked manner so that the engagement hole 10 is located on a projective movement locus p of the punch body 28.

The invention of claim 3 is characterized in that, in the manual binding tool of claim 1 or 2, an avoiding portion 39 is formed in the tie holding portion g, the avoiding portion avoiding an interference with a tip end portion 4*e* which projects while passing through the engagement hole 10 in the deformed portion 4*b* that is formed by the pushing mechanism h.

The invention of claim 4 is characterized in that, in the manual binding tool of any one of claims 1 to 3, a cutting mechanism c which cuts the projection tie portion 4*a* in a place in the vicinity of the head portion 5 is disposed.

The invention of claim 5 is characterized in that, in the manual binding tool of claim 4, the cutting mechanism c is configured by having a cutting blade 27 which is projectively and retractively slidable with respect to the tie holding portion g, and the cutting blade 27 and the punch body 28 are separably integrated with each other.

Effects of the Invention

According to the invention of claim 1, the pushing mechanism which pushes and deforms the passed tie portion located in the head portion, and which causes the deformed portion to be engaged into the engagement hole of the root tie portion is operated in a state where the head portion is supported by the tie holding portion g.

Namely, the pushing mechanism operates in a state where the head portion, and the tie portion which is located in the head portion are supported firmly and stably by the tie holding portion. Therefore, the pressing force due to the pushing mechanism is used effectively and efficiently for forming the deformed portion without escaping, and the plastically deformed portion can be surely pressed into the engagement hole to be engaged therewith.

As a result, the manual binding tool can be provided in which a mechanism for applying plastic deformation to the passed tie portion located in the head portion to forcibly cause the portion to engage with the root tie portion is further improved, and which is therefore improved so that a disadvantage that a pushing force acting on the head portion escapes is eliminated, plastic deformation can be performed in a firmly supported state, and slip-off prevention can be conducted more surely.

According to the invention of claim 2, when the head portion is supported by the tie holding portion, the engagement hole of the root tie portion is set in a state where the hole coincides with a pushing and deforming place of the punch body. By an operation of the pushing mechanism, therefore, the deformed portion can be engaged smoothly and surely into the engagement hole which is coaxial therewith. Consequently, there is an advantage that the effect of the invention claim 1 that more sure slip-off prevention due to the above-described sure punch engagement can be performed is further enhanced.

According to the invention of claim 3, by the avoiding portion formed in the tie holding portion, the amount of projection due to deformation of the deformed portion can be set to a large value which is larger than the thickness width of the head portion, in order to make sure the engagement state of the deformed portion formed by the punch body, and the engagement hole. Therefore, the engagement state due to material deformations of the root tie portion and the passed tie portion can be made more sure and stable. There is an advantage that the above-described effects of the invention of claims 1 and 2 are further enhanced.

According to the invention of claim 4, the cutting mechanism which cuts the projection tie portion in a place in the vicinity of the head portion is disposed, and hence a function of cutting away an extra projection tie portion can be performed in addition to the binding function due to the sure engagement of the tie portion by the pushing mechanism. Therefore, it is possible to provide a manual binding tool which is convenient and easy to use.

According to the invention of claim 5, the slide type cutting blade which is a component constituting the cutting mechanism, and the punch body are separably integrated with each other. Therefore, the specification can be set by selecting one of the specification including only the cutting mechanism excluding the punch body, that including only the pushing mechanism excluding the cutting blade, and that including the cutting mechanism and pushing mechanism having the punch body and the cutting blade. There is an advantage that the versatility is high.

MODE FOR CARRYING OUT THE INVENTION

Hereinafter, an embodiment of the manual binding tool of the invention will be described with reference to the drawings. In the application, a manner of fixing a tie portion 4 by means of punch engagement may be expressed as "punch lock type".

Embodiment 1

As shown in FIGS. 1 to 4, a manual binding tool A of Embodiment 1 is configured by including: a tool body 3 which has a cutting mechanism c and a tie holding portion g in a tip end portion, and a first lever 1 in a basal end portion; a second lever 2 which is pivotally supported on the tool body 3 about an axis P; a tightening mechanism a; a tightening linkage mechanism b; a cutting linkage mechanism d; a switching mechanism e; a tightening adjusting mechanism f; and the like. The tightening mechanism a, the tightening linkage mechanism b, the cutting linkage mechanism d, and the switching mechanism e are mainly disposed in the tool body 3, and the tightening adjusting mechanism f is mainly disposed in the first lever 1. The cutting mechanism c has a configuration including a pushing mechanism h.

Figure 5A:
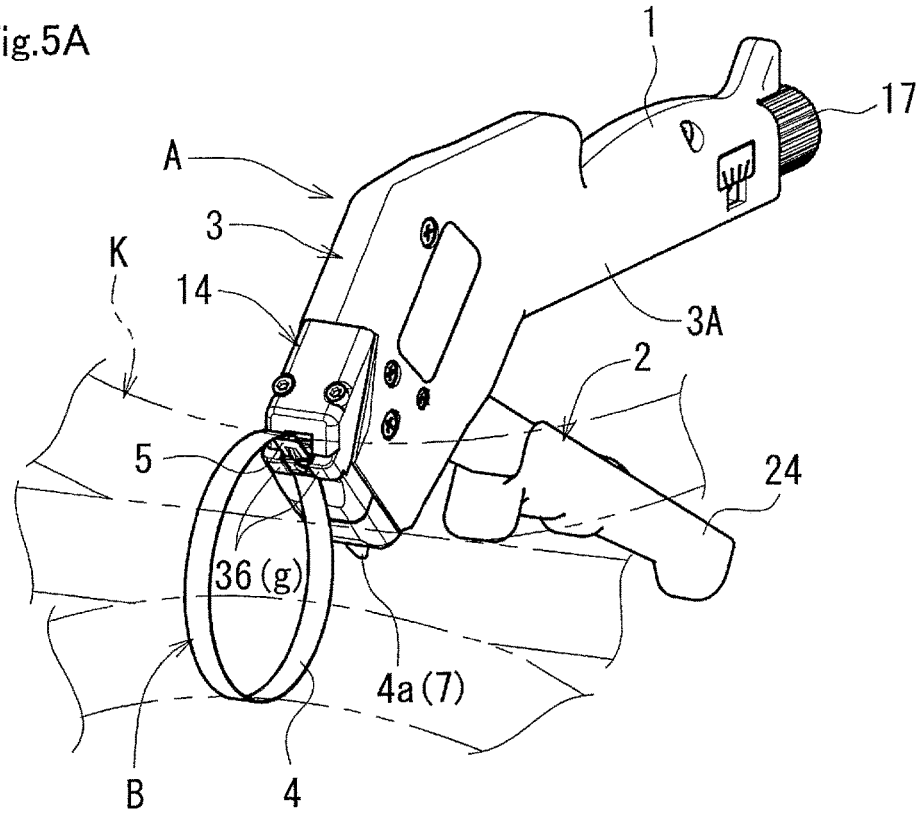
FIG. 5 shows an example of the use condition (waiting state) of the manual binding tool, (a) is a perspective view as viewed from the side of a to-be-bound article, and (b) is a partially cutaway front view including the internal structure.
Figure 5B:
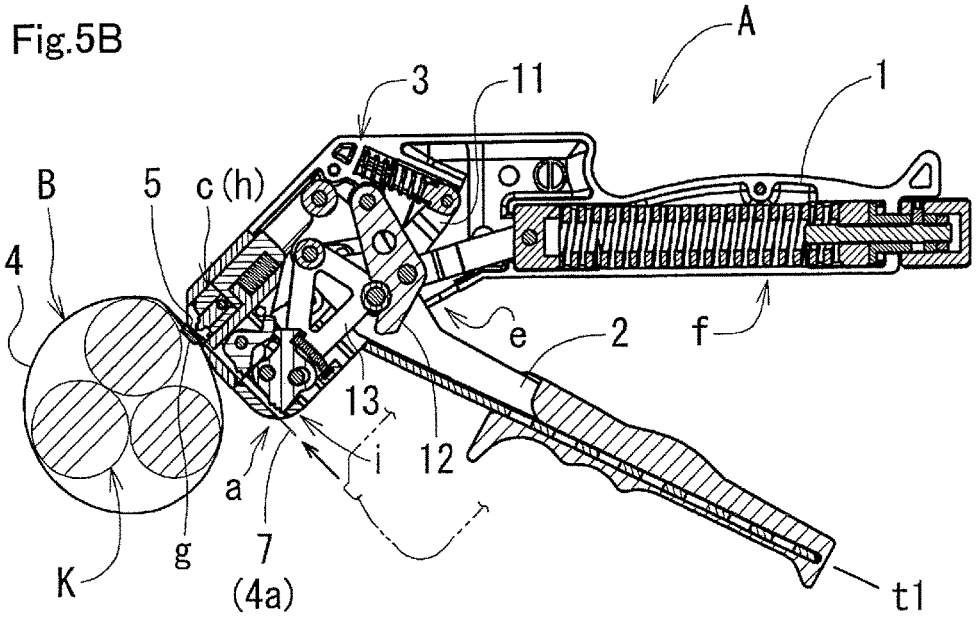

Initially, a binding work performed by the manual binding tool A will be briefly described. As shown in FIG. 5, first, a projection tie portion 4*a* of a binding tie B which is wound around a to-be-bound object K to be temporarily fixed thereto is inserted into a tie passage hole 6 (see FIG. 14) of the tool body 3 at a degree in which the tip end is passed therethrough, and a head portion 5 is inserted into the tie holding portion g.

Figure 1A:
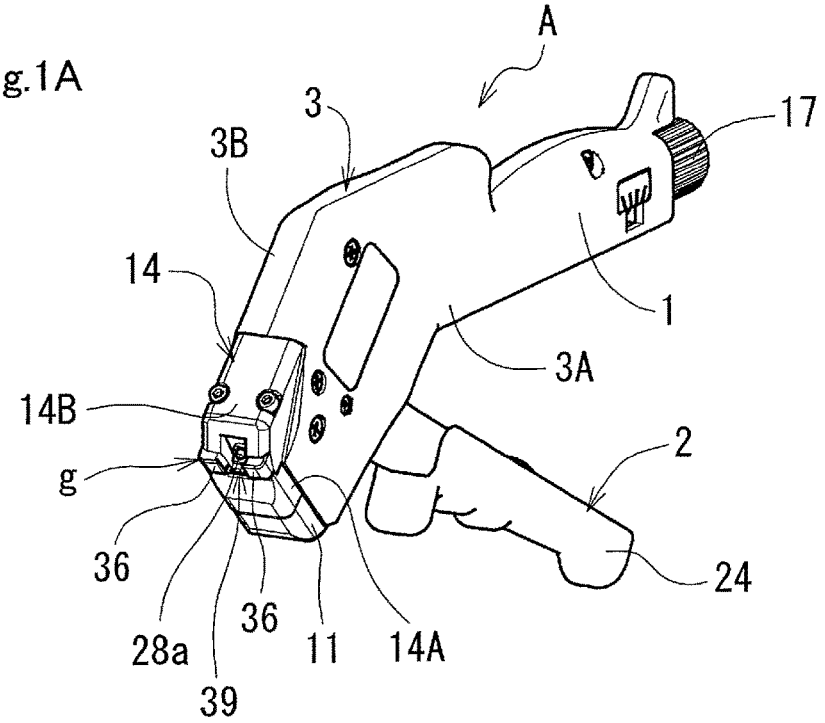
FIG. 1 shows a manual binding tool of Embodiment 1, (a) is a perspective view, and (b) is a front view.
Figure 1B:
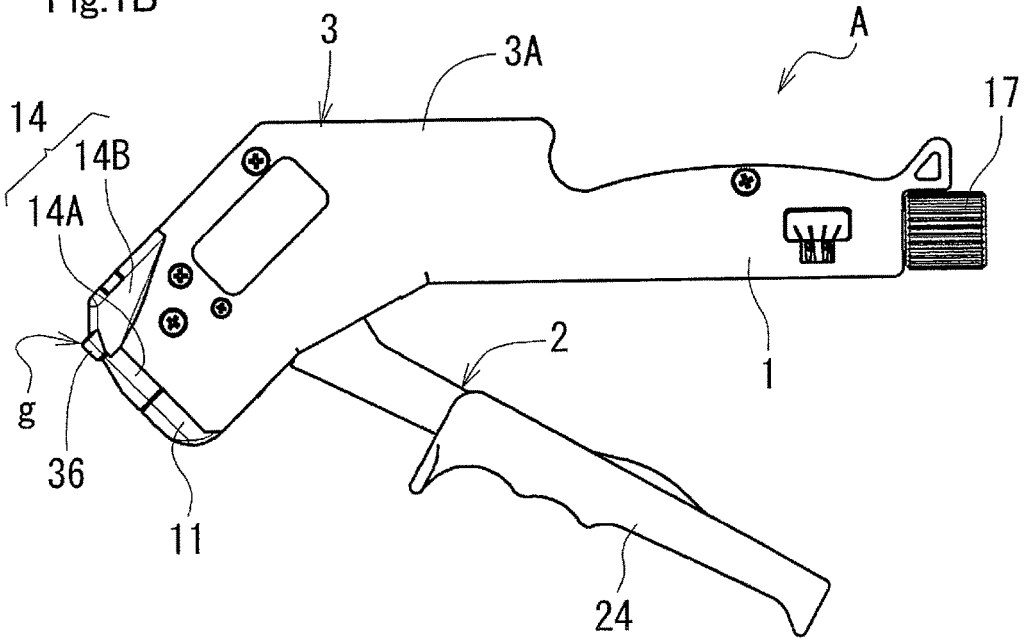
Figure 2A:
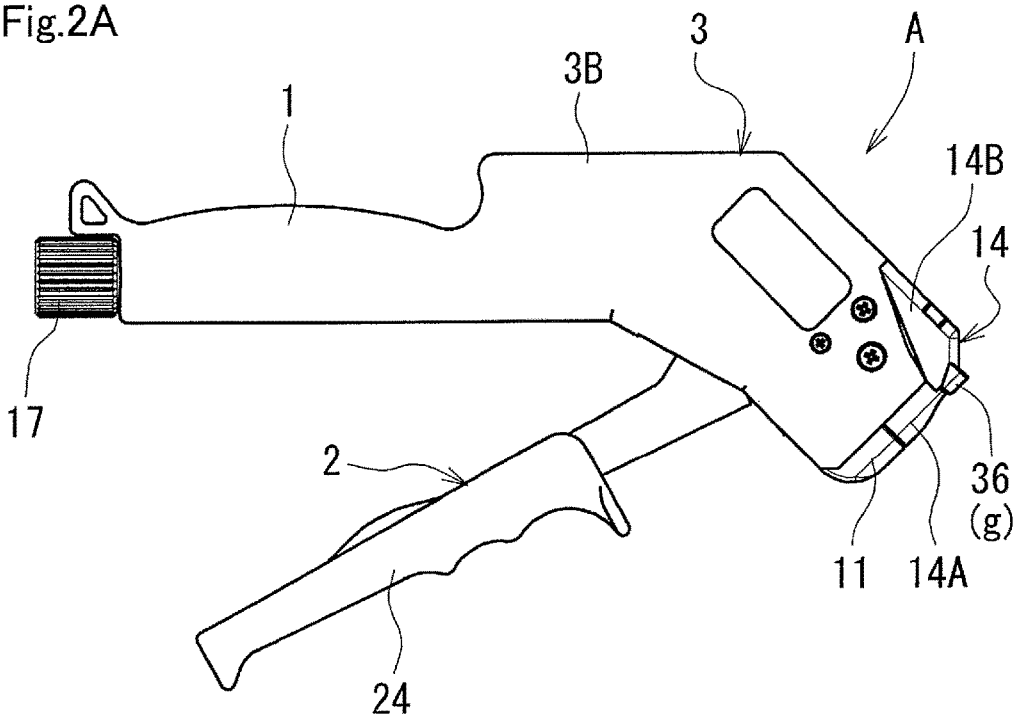
FIG. 2 shows the manual binding tool of FIG. 1, (a) is a rear view, and (b) is a left side view.
Figure 2B:
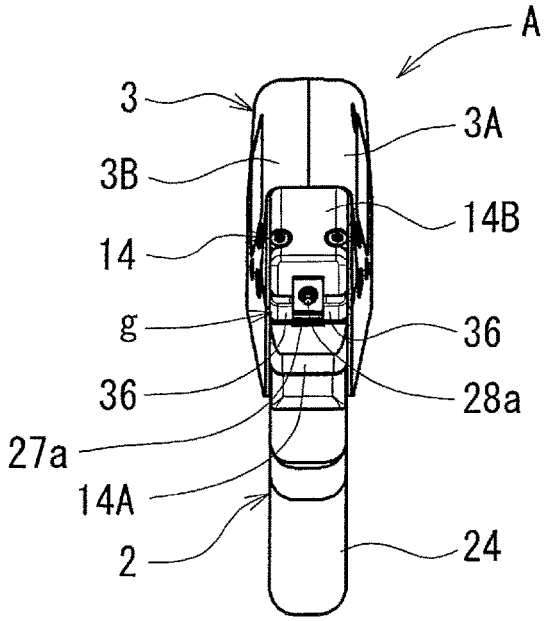
Figure 3:
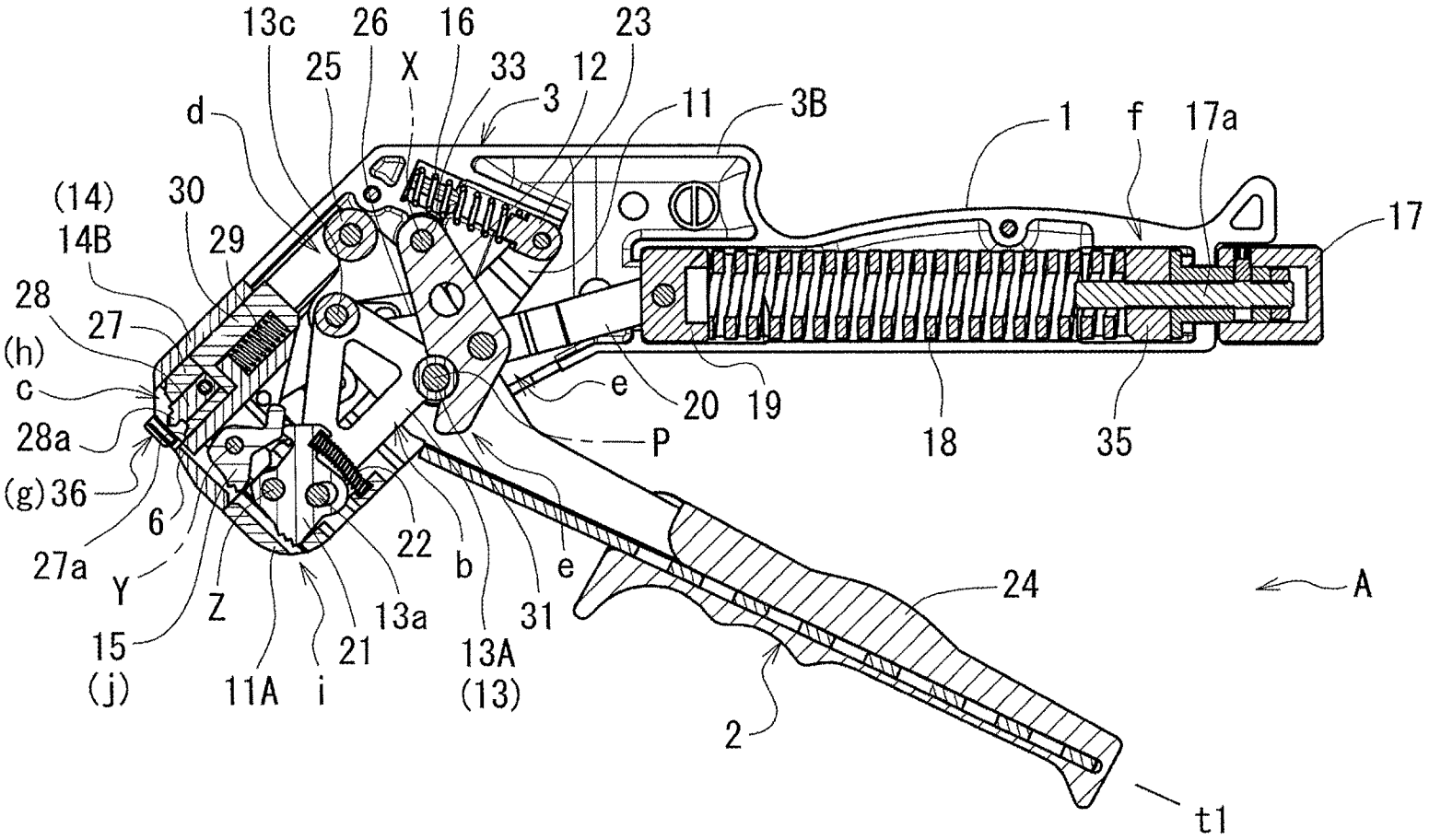
FIG. 3 is a front view showing the internal structure of the manual binding tool of FIG. 1.
Figure 9:
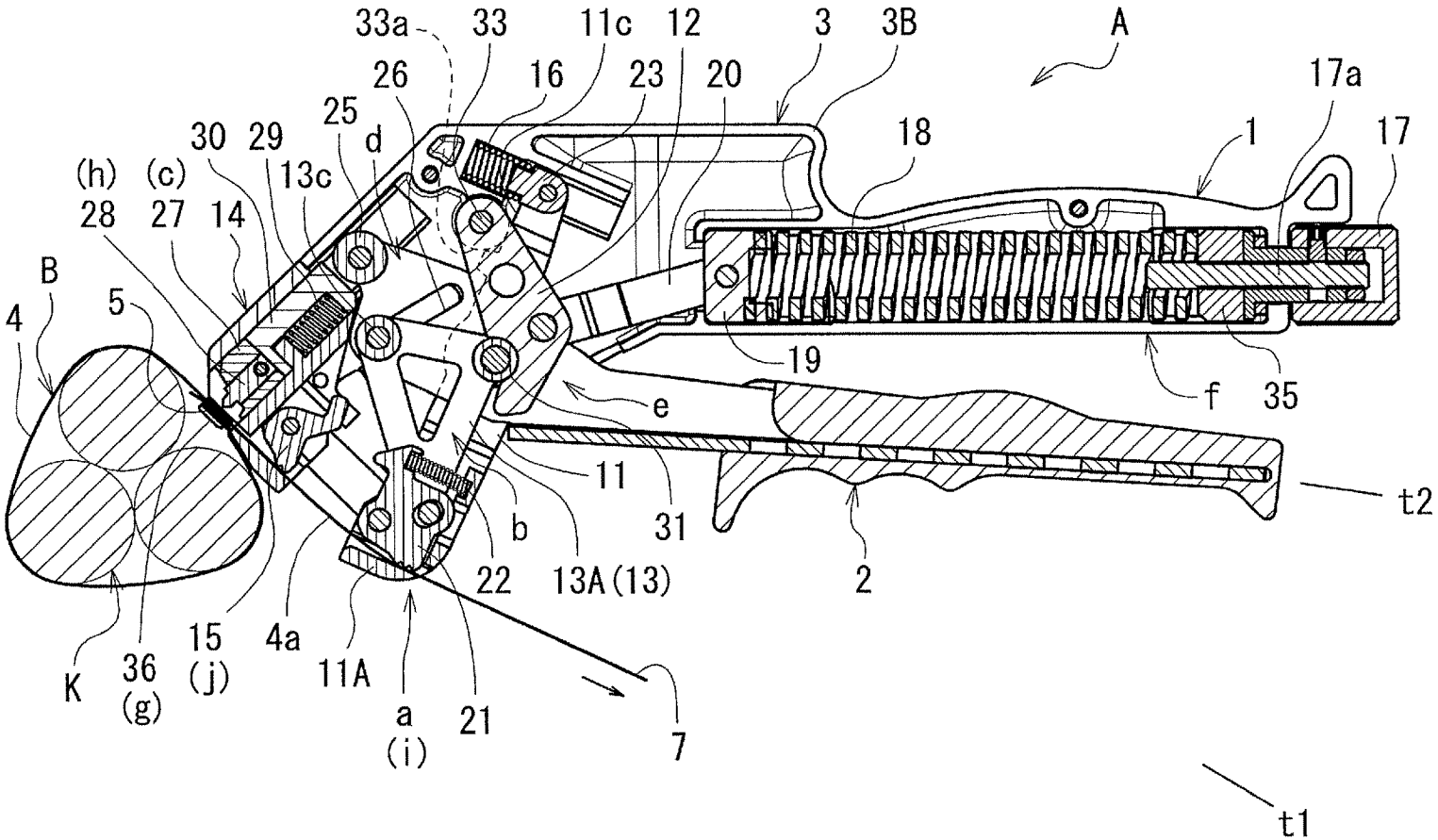
FIG. 9 is a functional view showing a state where, in the tightening step, a second lever is maximally swung to be located at a second position.

As shown in FIGS. 3 and 9, then, the first lever 1 and the second lever 2 are relatively approaching swung until the second lever 2 is moved from a first position t1 to a second position t2, and gripping manipulation in which the projection tie portion 4*a* is forcibly pulled with respect to the head portion 5 held by the tie holding portion g, by actuation of the tightening mechanism a, and a grip releasing manipulation are performed.

When the gripping manipulation and the grip releasing manipulation are performed one time or a plurality of times, thereby causing the tightening force to reach a predetermined value, the swinging movement of the second lever 2 from the second position t2 to a third position is allowed by subsequent gripping manipulation.

As a result of the swinging of the second lever 2 from the second position t2 to the third position t3, the pushing mechanism h and the cutting mechanism c operate (see FIGS. 12 and 13), the tie portion 4 is engaged with the head portion 5, and the projection tie portion 4*a* is cut in a place proximity to the head portion 5.

Figure 6A:
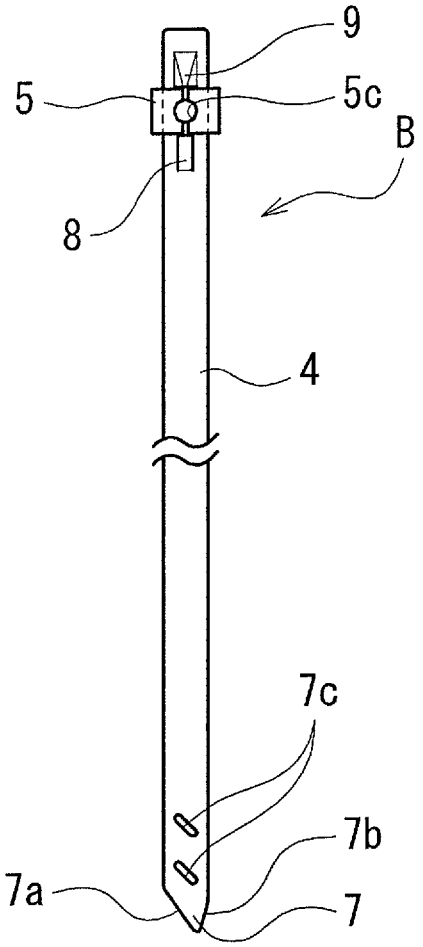
FIG. 6 shows a metal-made binding tie, (a) is an overall view in a free state, and (b) is a rear view in the vicinity of a head portion.
Figure 6B:
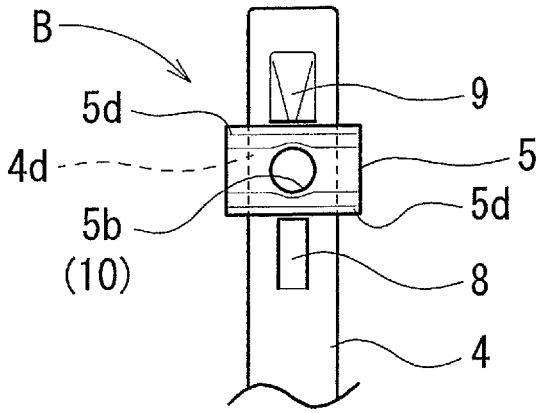
Figure 7A:
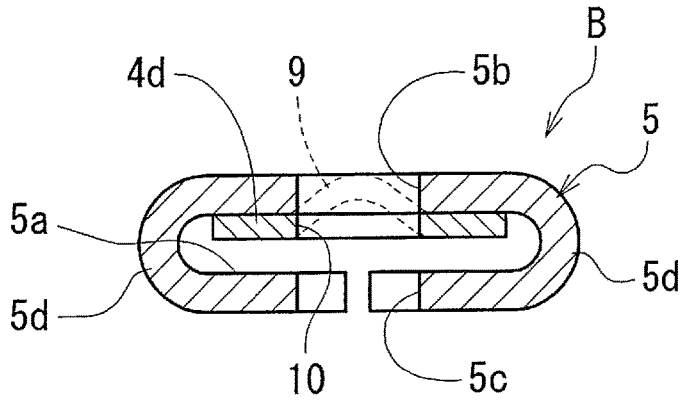
FIG. 7 shows the structure of the vicinity of the head portion of the binding tie of FIG. 6, (a) is a longitudinal sectional view, and (b) is a transverse sectional view.
Figure 7B:
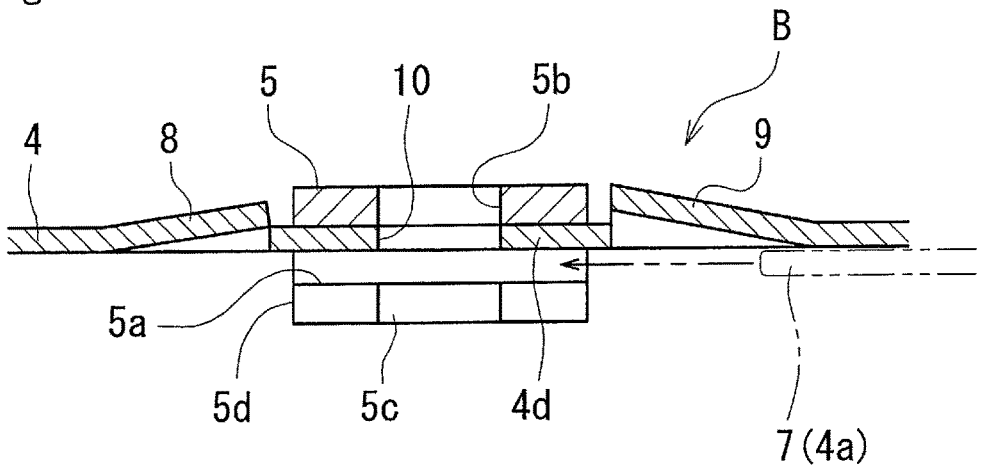

As shown in FIGS. 6 and 7, the binding tie (binding band) B which is used in the manual binding tool A of Embodiment 1 is a separation type metal tie in which the head portion 5 that is made of a metal such as a stainless steel plate is incorporated in the long band-like tie portion 4 that is made of a metal such as a stainless steel plate.

The tie portion 4 is configured by a steel plate band which is small in thickness and in width, and has: a pointed tip end 7 configured by a long inclined edge 7*a* and a short inclined edge 7*b*; a pair of holes 7*c* which are in the vicinity of the pointed tip end, and which have an inclined rounded-corner rectangular shape; a cut and raised claw 8 which is on the root side; a stopper 9 which is mostly on the root side; and an engagement hole 10.

The head portion 5 has a flat and substantially C-like shape which is formed by bending a steel plate which is thicker than the tie portion 4, and has: a passage path 5*a* through which the tie portion 4 is to be passed; an escaping hole 5*b* on the rear side (the side of the to-be-bound object); a substantially circular cutaway 5*c* which is on the front side, and which is used for passing a punch; and the like. The width in the thickness direction of the passage path 5*a* is set to a dimension which allows two tie portions 4 in a stacked state to be passed therethrough without forming a substantial gap.

The head portion 5 is inserted from the pointed tip end 7 into the tie portion 4, passed over the cut and raised claw 8 while elastically deforming it, and engagedly disposed at a position between the cut and raised claw 8 and the stopper 9. The binding tie B in which the head portion 5 is disposed on the tie portion 4 is configured so as to enable a state where, as shown in FIG. 7, the escaping hole 5*b*, the engagement hole 10, and the substantially circular cutaway 5*c* are aligned (stacked) in a straight line.

Next, the manual binding tool A will be described. As shown in FIGS. 1 to 4, 10, and 14, the manual binding tool A is configured by having: the tool body 3 which integrally includes the first lever 1; the second lever 2 which is pivotally supported about the axis P on the tool body 3; a base arm 11 which is pivotally coupled to the tool body 3 about the axis P; and the like.

In the tool body 3, a tension arm 12 which is movable swingly about a fulcrum X, a triangular link 13 which is usually swingable while setting the axis P as a virtual center, the cutting mechanism c, a chuck claw 15 which is swingable about a fulcrum Y, a return spring 16 for the base arm 11, and the like are disposed.

The first lever 1 which is a projection portion of the tool body 3 is provided with the tightening adjusting mechanism f configured by an adjustment knob 17 which can be rotated, a tightening force adjusting spring 18, a spring receiver 19 for the tightening force adjusting spring 18, and the like. A tension bar 20 which is pivotally coupled to both the tension arm 12 and the spring receiver 19 is disposed.

The base arm 11 is provided with an engagement claw 21 which is swingable about a fulcrum Z, a return spring 22 which tries to return the engagement claw 21 to a waiting state, a spring receiver 23 which is pivotally coupled to be used for the return spring 16, and the like.

The second lever 2 is covered with a grip 24 which is made of a synthetic resin or the like, a cutter roller 25 is supported at the tip end, and a linear engagement groove 26 is formed on the side of the tip end. The engagement groove 26 is placed and set in a state where the groove is inclined so that the closer to the tip end side (on the side of the tie holding portion g), the larger the diameter related to the axis P.

The tightening adjusting mechanism f functions in the following manner. When the adjustment knob 17 which is rotatably supported by the first lever 1 is rotated to the left and fastened, a square nut 35 screwed to a knob shaft 17*a* is moved to the left side in FIG. 3 (to the side of the axis P), and the tightening force adjusting spring 18 which is between the nut and the spring receiver 19 is compressed to increase the elastic force. This causes the force by which the tension arm 12 pressingly urges the triangular link 13, to be increased, and a setting tightening force is adjusted in the increasing direction.

When the adjustment knob 17 is rotated to the right and loosened, conversely, the square nut 35 is moved to the right side in FIG. 3 (to the side of the adjustment knob 17) to separate from the spring receiver 19, and the tightening force adjusting spring 18 expands to weaken the elastic force. Therefore, the force by which the tension arm 12 pressingly urges the triangular link 13 is reduced, and the setting tightening force is adjusted in the decreasing direction.

The cutting mechanism c is configured by: a holder 30 which is housed and supported in a cutter body 14 so as to be extractively and retractively slidable; a cutting blade 27 which is integrally supported by the holder 30, and which is extractively and retractively slidable; a punch body 28 which is inserted into the cutting blade 27 to be integrally supported thereby; a return spring 29 for returning the cutting blade 27 to a waiting position; and the like. In a usual state where the cutter roller 25 does not push the holder 30, the return spring 29 causes the cutting blade 27 and the punch body 28 to be in a retracted waiting position (see FIG. 14).

Although described in detail later, the punch body 28 is used for pushing the tie portion 4 to be engaged with the tie portion 4 which is in the inner side, and the head portion 5 by means of plastic deformation, and cooperates with a pin 34 (described later) and the like to constitute the pushing mechanism h.

Figure 4:
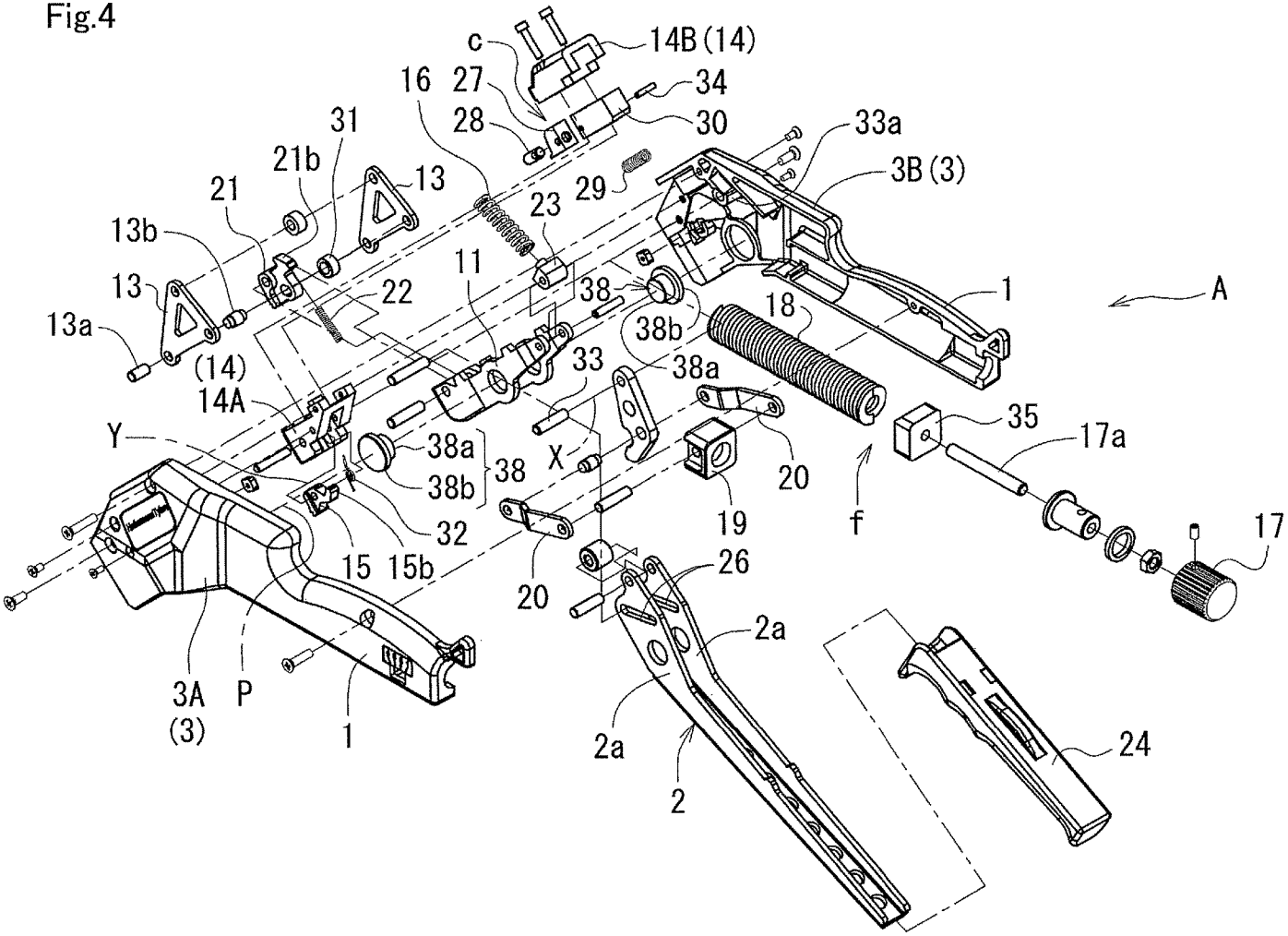
FIG. 4 is an exploded perspective view showing the structure of the manual binding tool of FIG. 1.
Figure 14:
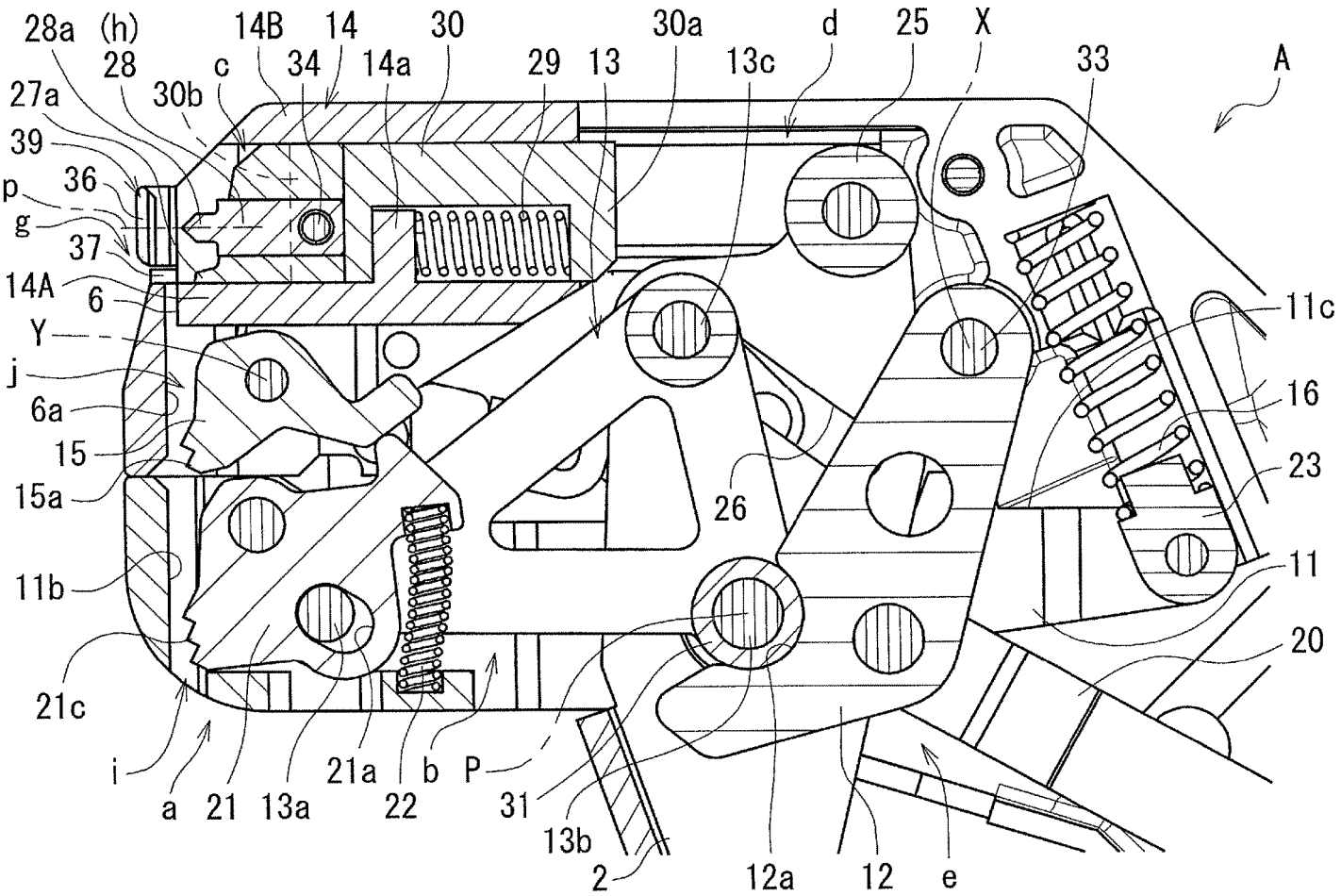
FIG. 14 is an enlarged front view showing main portions of a tool body in FIG. 3.

As shown in FIGS. 3, 4, and 14, the cutter body 14 is configured by a lower body 14A and an upper body 14B which is placed above the lower body, and the cutting mechanism c is housed and configured between the both bodies 14A, 14B. The return spring 29 is inserted and placed between an upper projection 14*a* of the lower body 14A and a holder back wall 30*a*.

In the cutting blade 27, its root portion is placed between a pair of right and left front sidewalls 30*b*, 30*b* of the holder 30. The cutting blade is integrated together with the punch body 28 which is housed in a passing hole (not denoted by a reference numeral) of the blade, with the holder 30 by the pin 34 that is passed therethrough.

During a normal period (the period other than "punch cutting step" which will be described later) when the cutting mechanism c is not manipulated by the second lever 2, the cutting mechanism c is return-urged by the elastic force of the return spring 29 to a waiting state where a front wall 30*c* of the holder 30 butts against the upper projection 14*a*, and a blade portion 27*a* and a pointed punch portion 28*a* are separated from the binding tie B that is held by the tie holding portion g. The tip end of the punch portion 28*a* may have a pointed angle shape (see FIG. 15) or a slightly rounded shape (see FIG. 13).

The chuck claw 15 which is pivotally supported at the fulcrum Y by the lower body 14A is elastically urged in a state where a gear-toothed chuck portion 15*a* butts against a guide wall 6*a* of the tie passage hole 6, by a torsion coil spring 32 (see FIG. 4) disposed about the fulcrum Y.

The tool is configured in a state where the second lever 2 having a pair of right and left sidewall portions 2*a*, 2*a* is placed inside the base arm 11 having a pair of right and left plate members, the triangular link 13 is placed between the sidewall portions 2*a*, 2*a*, and the tension arm 12 is located between a pair of right and left plate portion 13A, 13A constituting the triangular link 13.

In the triangular link 13 configured by the pair of right and left plate members, its tip end portion is pivotally supported by a long hole 21*a* of the engagement claw 21 through a tip-end pin 13*a*, a root pin 13*b* is supported in a root portion, and a support roller 31 which is fitted onto the root pin 13*b* is engaged in an arcuate tip-end recess 12*a* of the tension arm 12.

An intermediate pin 13*c* is supported in an intermediate portion of the triangular link 13, and passed through and engaged with the engagement groove 26 so as to be relatively rotatable and movably in the longitudinal direction of the groove.

The tension arm 12 is elastically urged in a state where the arm is swung about the fulcrum X toward the tie holding portion g by the tightening force adjusting spring 18 of the tightening adjusting mechanism f, whereby, in the usual state (the waiting state where the second lever 2 is in the first position t1), the tip-end pin 13*a* is positioned in the end of the long hole 21*a* on the side of the tie holding portion g, and the intermediate pin 13*c* is positioned in the end of the engagement groove 26 on the side of the tie holding portion g. Because of the positional relationship of the tip-end and intermediate pins 13*a*, 13*c*, the root pin 13*b* is placed approximately coaxially with the axis P.

As shown in FIGS. 1, 2, 5, 11, and 13, the tie holding portion g is configured so as to be able to receive and hold the head portion 5, by fitting right and left arcuate portions 5*d*, 5*d* of the head portion 5, between substantially semicircular inner circumferential portions of a pair of right and left hook portions 36, 36 at the tip end of the upper body 14B. A restriction projection 37 which is formed on an upper surface portion of the tip end of the lower body 14A is located immediately below the hook portions 36, 36. A structure is formed in which the end edge of the head portion 5 butts against the restriction projection 37 to function as a stopper for a co-movement of the head portion 5 due to the operation of pulling the projection tie portion 4*a*, and the head portion is not further pulled in and is positioned therein.

Figure 13:
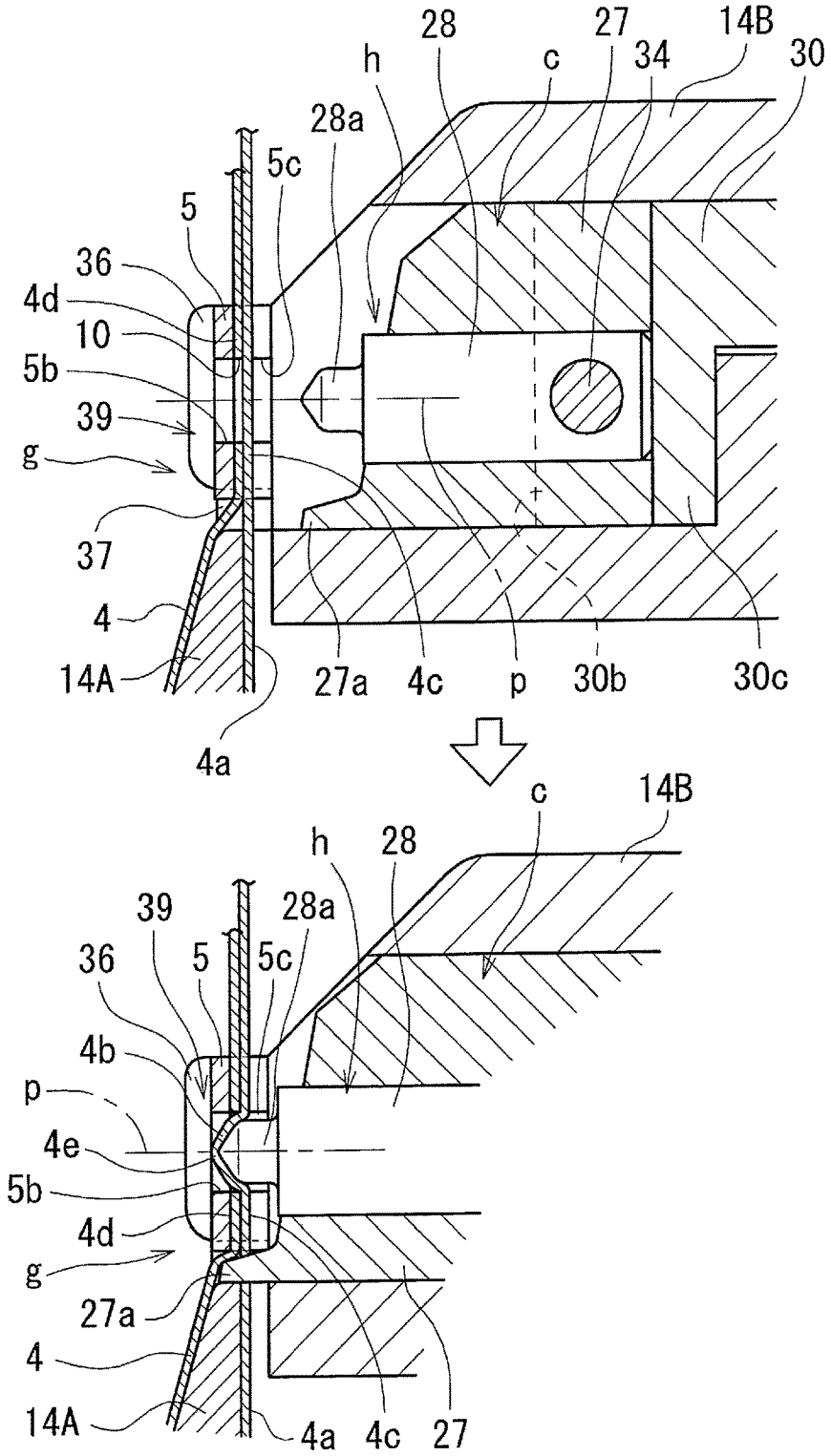
FIG. 13 is an enlarged view of main portions showing an operation state in the punch cutting step.

The dimensions are set so that, in the positioned state, as shown in FIG. 13, the escaping hole 5*b* and substantially circular cutaway 5*c* of the head portion 5, the engagement hole 10 of the tie portion 4, and the punch portion 28*a* are coaxial with each other.

In the state where the head portion 5 is supported by the tie holding portion g, namely, the tie holding portion g and the punch body 28 are placed in a linked manner so that the engagement hole 10, the escaping hole 5*b*, and the substantially circular cutaway 5*c* are located on a projective movement locus p of the punch body 28.

In the state where the binding tie B is wound around the to-be-bound object K (see FIGS. 5, 8, 13, and the like), here, the portions in the tie portion 4 are referred to as follows for the sake of convenience. First, the portion (portion between the cut and raised claw 8 and the stopper 9) on which the head portion 5 is previously surroundingly held by the above-described engagement mounting is defined as the root tie portion 4*d*, that located in the head portion 5 as the passed tie portion 4*c*, that which is projectively deformed by the pushing mechanism h as the deformed portion 4*b*, and that which is passed and projected through the engagement hole 10 of the deformed portion 4*b* as the tip end portion 4*e*.

The pushing mechanism h can be defined as a mechanism which, in the state where the head portion 5 is supported by the tie holding portion g, pushes and deforms the passed tie portion 4*c*, and which causes the deformed portion 4*b* to be engaged into the engagement hole 10 formed in the root tie portion 4*d*.

As shown in FIG. 4, the tool body 3 is configured by a left body case 3A and a right body case 3B, and the first lever 1 is configured by their basal end portions (not denoted by a reference numeral). The reference numeral 38 denotes a pair of right and left stepped circular support shafts which are flat. Each of the support shafts is configured by a small-diameter portion 38*a* which supports the base arm 11 and the second lever 2, and a flange portion 38*b* which is fitted in and supported by the corresponding one of the left and right left body cases 3A, 3B.

Figure 15:
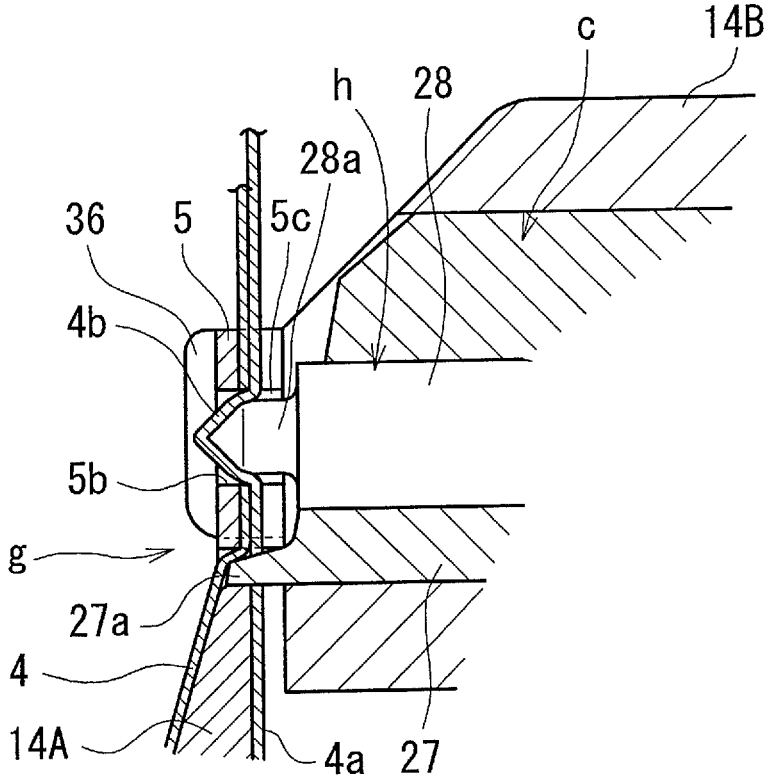
FIG. 15 is an enlarged view of main portions showing a punch cutting step in which the amount of projection is large.

By the way, a formation into a state where, according to the shape, dimension setting, and the like of the punch body 28, the tip end portion 4*e* is projected by a degree which is larger than the thickness width of the head portion 5 as shown in FIG. 15 may be possible. In order to allow the punching step to be smoothly performed without trouble in such a case, a configuration is preferably employed where a space is formed between the right and left hook portions 36, 36 of the tie holding portion g to form an avoiding portion 39, and an interference with the tip end portion 4*e* produced by the pushing mechanism h can be avoided.

In the case where, as shown in FIG. 13, the projection amount of the tip end portion 4*e* is within the thickness width of the head portion 5, the avoiding portion 39 due to by a space or a cutaway may not be formed (example: a configuration where the right and left hook portions 36 are continuously integrated with each other). Considering that an interference with the cut and raised claw 8 and stopper 9 which are projected by an amount larger than the thickness width of the head portion 5 is avoided, and that the manner of mounting the head portion 5 to the tie holding portion g can be viewed, a configuration where the avoiding portion 39 is disposed is more preferable.

Next, the manner of the binding work in which the binding tie B is used by the manual binding tool A will be described. As shown in FIG. 5 and the like, first, a manual attaching step is performed in which the binding tie B is wound around the to-be-bound object K such as three wire harnesses by manual manipulation using the fingers, and the tie portion 4 is passed from the pointed tip end 7 through the head portion 5, and slightly pulled to be temporarily fixed thereto.

The manipulation of inserting the projection tie portion 4*a* which projects through the head portion 5 in the tie portion 4, into the tie passage hole 6 formed in the tool body 3 is performed to cause a state where, as shown in FIG. 5(*b*), the pointed tip end 7 projects to the outside of the tool through a passage path 11*a* in a tip end portion of the base arm 11.

FIG. 5(*b*) shows a state where the binding tie B is attached to the manual binding tool by the manual attaching step, and FIG. 3 shows only the manual binding tool in the state. FIGS. 3 and 5(*b*) show the waiting state where the gripping manipulation is not performed, i.e., a state where the second lever 2 is in the first position t1 which is the waiting position.

In the waiting state, a buttock portion 15*b* is pushed by a basal-end projection 21*b* of the engagement claw 21, the chuck claw 15 is forcibly swung against the elastic force of the torsion coil spring 32 (see FIG. 4), and the chuck portion 15*a* is clearly separated from the guide wall 6*a* by a distance which is larger than the thickness of the tie portion 4. Namely, the chuck claw 15 is in a state where it exerts no action on the projection tie portion 4*a* (non-operation state in the return preventing mechanism j).

In addition, the engagement claw 21 is in a state where a gear-toothed tip end portion 21*c* is clearly separated from a tip-end inner wall 11*b* of the base arm 11 (see FIG. 10) by a distance which is larger than the thickness of the tie portion 4, by the elastic force of the return spring 22, and also the engagement claw 21 exerts no action on the projection tie portion 4*a*.

When the first lever 1 and the second lever 2 are then gripped by the fingers (not shown) of the right hand or the like, first, very small swinging of the second lever 2 with respect to the first lever 1 forms a state where the projection tie portion 4*a* is clamped and engaged between the tip end portion 21*c* of the engagement claw 21 and the tip-end inner wall 11*b*. From the waiting state shown in FIGS. 3 and 14, namely, the triangular link 13 which is pushed through the intermediate pin 13*c* that is positioned in the end of the engagement groove 26 on the side of the tie holding portion g is very slightly swung substantially about the axis P by relative rotation of the root pin 13*b* and the support roller 31, and the tip-end pin 13*a* causes the engagement claw 21 to be forcibly swung about the fulcrum Z against the elastic force of the return spring 22.

Figure 8:
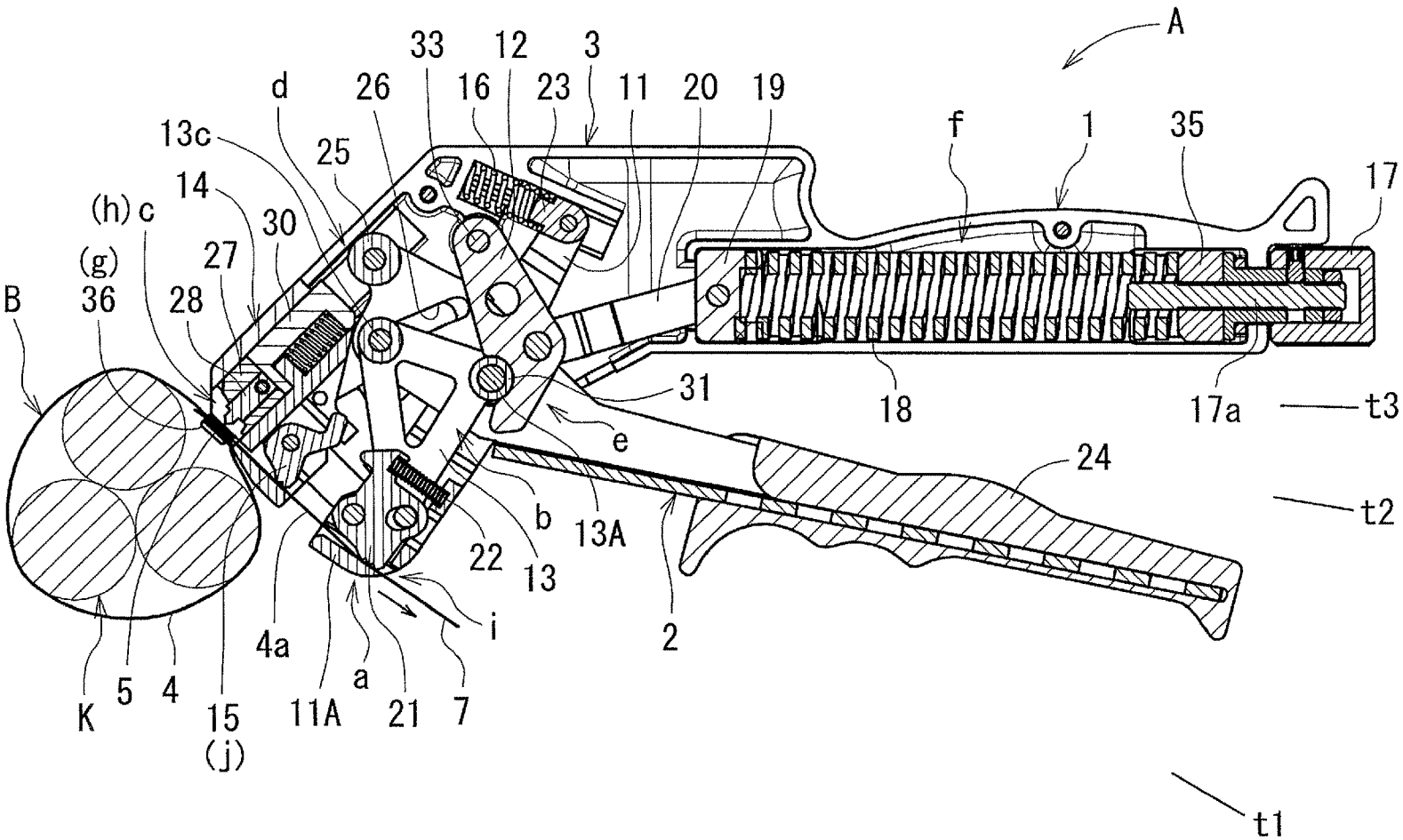
FIG. 8 is a functional view showing a tightening step of pulling a projection tie portion.

Then, the tip end portion 21*c* of the engagement claw 21 pushes the tip-end inner wall 11*b* across the projection tie portion 4*a*, the second lever 2 and the base arm 11 are integrally swung about the axis P as shown in FIG. 8, and the engagement claw 21 exerts a self-lock function to forcibly pull and move the projection tie portion 4*a* gripped by the claw and the tip-end inner wall 11*b*, with respect to the head portion 5. As described above, the pulling portion i is configured by the tip end portion 21*c* and the tip-end inner wall 11*b*, i.e., by the engagement claw 21 and the base arm 11.

At this time, the chuck claw 15 is slightly pressed against the projection tie portion 4*a* by the torsion coil spring 32, and a state is formed in which the self-lock function of blocking a return movement of the projection tie portion 4*a* to the head portion 5 can be exerted. However, a movement in the direction along which the projection tie portion 4*a* further projects is allowed (see FIGS. 8 and 9).

When the projection tie portion 4*a* is pulled, the tightening step is performed in which the length of the projection tie portion 4*a* wound around the to-be-bound object K is reduced, and the to-be-bound object K is tightened. FIG. 8 shows a state in the middle of gripping, i.e., the tightening step.

Then, the forced movement of the chuck claw 15 due to the pushing of the buttock portion 15*b* by the basal-end projection 21*b* of the engagement claw 21 is cancelled by the above-described very small swinging of the second lever 2 from the first position t1, and therefore the chuck claw 15 is projected and swung by the elastic force of the torsion coil spring 32 so that the chuck portion 15*a* is pressed and butted against the guide wall 6*a*.

This produces a state the projection tie portion 4*a* is clamped between the chuck portion 15*a* and the guide wall 6*a*. As described above, therefore, the self-lock function of the chuck claw 15 is produced, and the return movement to the head portion 5 is blocked. Namely, the return preventing mechanism j is configured by the lower body 14A having the guide wall 6*a*, and the chuck claw 15.

When the projection tie portion 4*a* is not gripped by the pulling portion i, such as when the second lever 2 is openly swung from the second position t2 to the first position t1, a return movement of the projection tie portion 4*a* to the head portion 5 is blocked by the return preventing mechanism j. During a period when the projection tie portion 4*a* is not pulled, such as a return swinging step, namely, the tie portion 4 is not returned. Therefore, it is not necessary to perform unreasonable manipulation in which, when the second lever 2 located at the second position t2 is to be returned to the first position t1, the returning manipulation must be quickly performed because the self-lock function by the engagement claw 21 cannot be expected, and usual return returning manipulation can be performed.

When the relatively approaching swinging of the second lever 2 toward the first lever 1 due to gripping is further conducted, the second lever reaches the second position t2 where the second lever cannot be further swung by gripping, as shown in FIG. 9, and the step of tightening the tie portion 4 by a single gripping operation is ended.

Namely, the tightening step is performed in which the tightening linkage mechanism b and the tightening mechanism a are caused to operate by the relative swinging of the second lever 2 from the first position t1 to the second position t2, and the projection tie portion 4*a* is clamped and pulled by the engagement claw 21.

Figure 10:
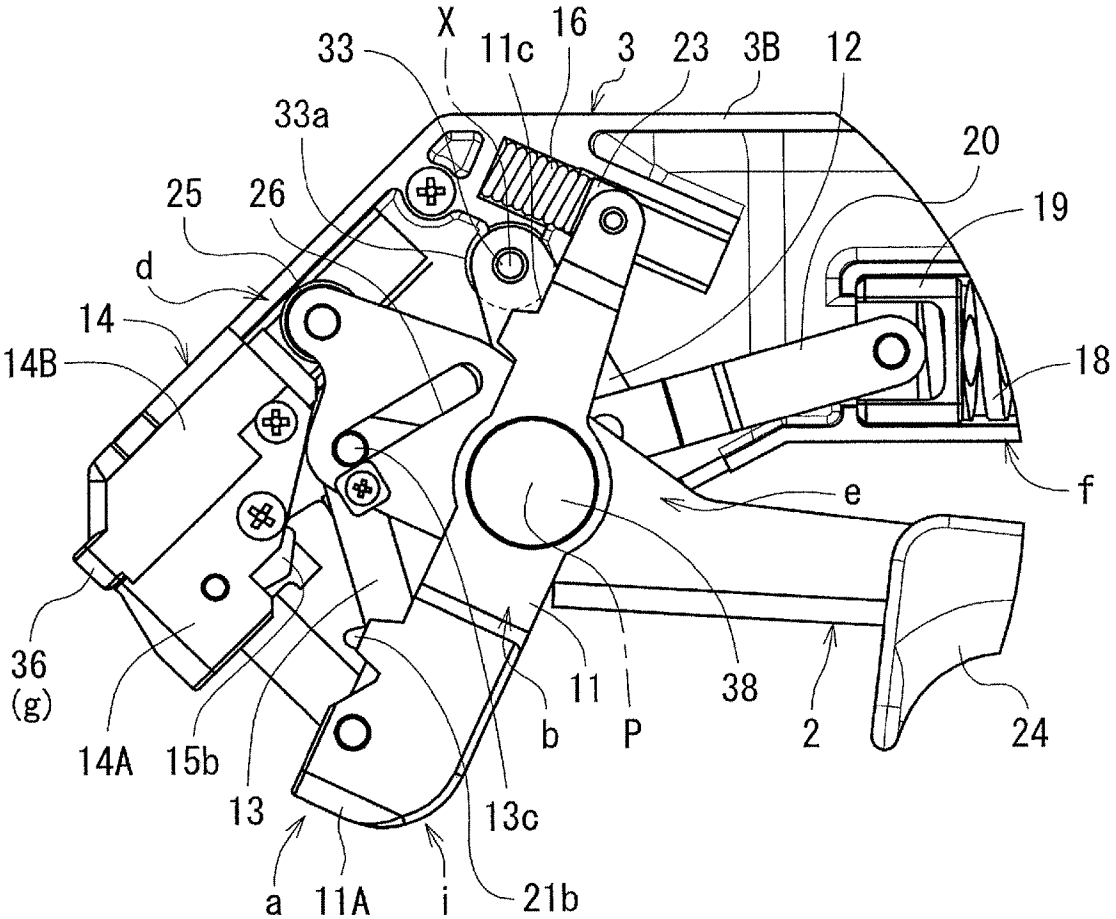
FIG. 10 is an enlarged front view showing main portions of the manual binding tool shown in FIG. 9.

The second position t2 is a position which is determined by butting the thickness end surface 11*c* on the side of the basal end of the base arm 11 against large-diameter base portions 33*a* for a support shaft 33 having the fulcrum X of the tension arm 12 as shown in FIGS. 9 and 10. FIG. 10 is a front view of main portions in FIG. 9.

When the tightening step is ended, and the gripping of the first and second levers 1, 2 by the fingers is released in the state shown in FIG. 9, the return swinging step is performed in which the base arm 11 and the second lever 2 are integrally return-swung by the elastic force of the return spring 16 acting on the basal end side of the base arm 11, and self-returns to the first position t1.

In the state where the second lever 2 is return-swung, the above-described self-lock function due to the chuck claw 15 is exerted, and the pulled projection tie portion 4*a* is engaged and held so as not to return. Since the elastic force of the tightening force adjusting spring 18 does not substantially act on the triangular link 13, and that of the return spring 22 acts thereon, in addition, the clamping force which is produced by the engagement claw 21, and which is applied on the projection tie portion 4*a* vanishes, and only the second lever 2 and the base arm 11 are return-swung while the pulled projection tie portion 4*a* remains as is.

When the tightening force of the binding tie B, more specifically the pulling force of the projection tie portion 4*a* reaches a value which is previously set by the tightening adjusting mechanism f as a result of performing one time or a plurality of times a set of the tightening and return swinging steps that have been described, the process is automatically switched to the punch cutting step.

Figure 11:
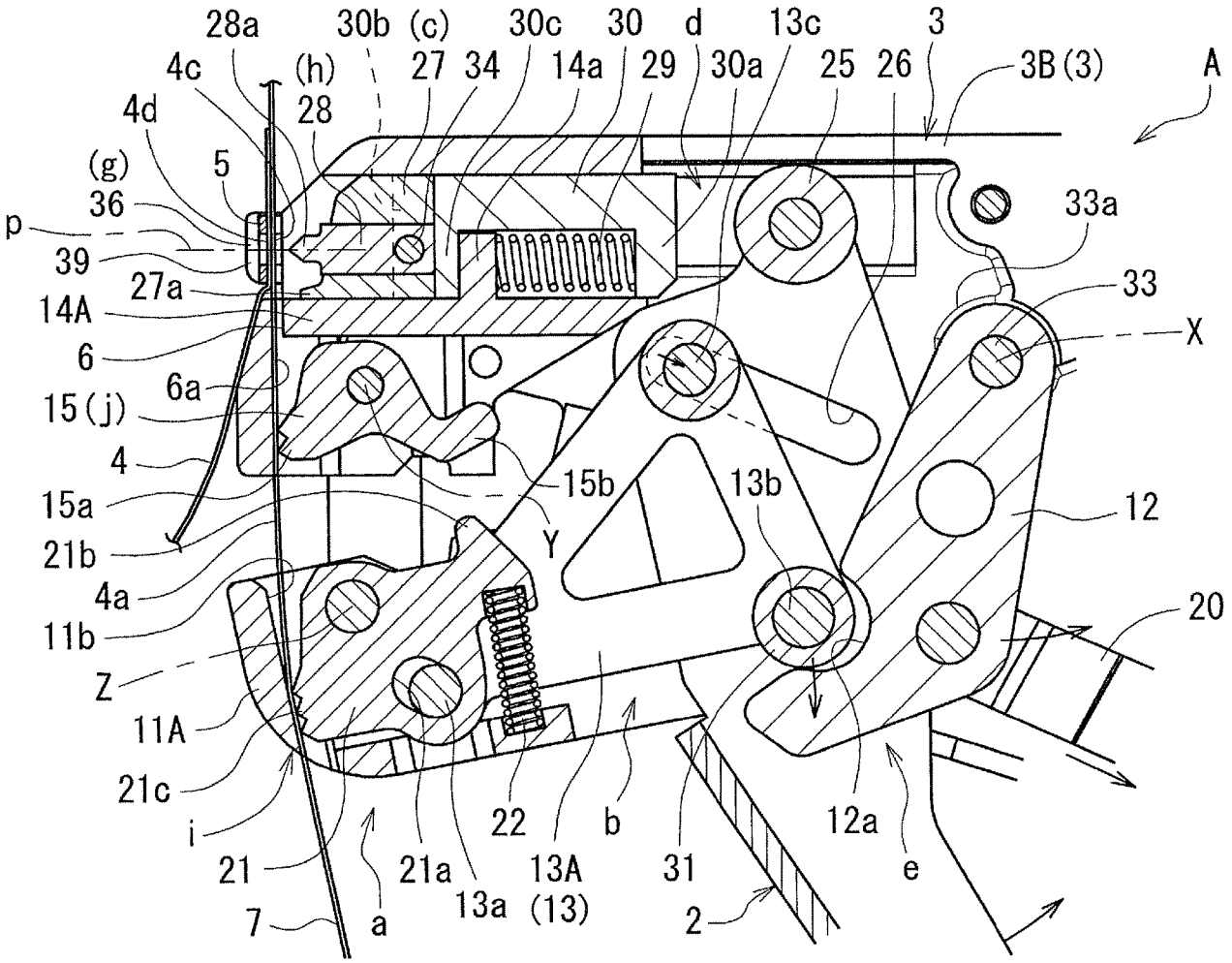
FIG. 11 is a functional view of main portions showing a state where the tightening force reaches a preset value, an engagement between a triangular link and a tension arm is cancelled, and the tightening step is being transferred to a punch cutting step.

When the tightening force is the preset value, namely, the engagement between the support roller 31 and the tip-end recess 12*a* caused by the tightening adjusting mechanism f (tightening force adjusting spring 18) which determines the preset value cannot be maintained, and the engagement claw 21 and base arm 11 which exert the self-locking function cannot be further swung in the tie pulling direction. In accordance with further gripping of the second lever 2, therefore, the intermediate pin 13*c* is moved in the engagement groove 26 toward the first lever 1 as shown in FIG. 11, whereby the tension arm 12 which is pushed by the support roller 31 is retractively swung about the fulcrum X toward the first lever 1, and the support roller 31 is disengaged from the tip-end recess 12*a* and then moved.

While leaving as is the base arm 11 which cannot be further swung, thus, only the second lever 2 is further gripped and swung toward the first lever 1, and the cutter roller 25 located at the tip end of the second lever 2 which is swung beyond the second position t2 pushingly drives the holder 30.

Figure 12:
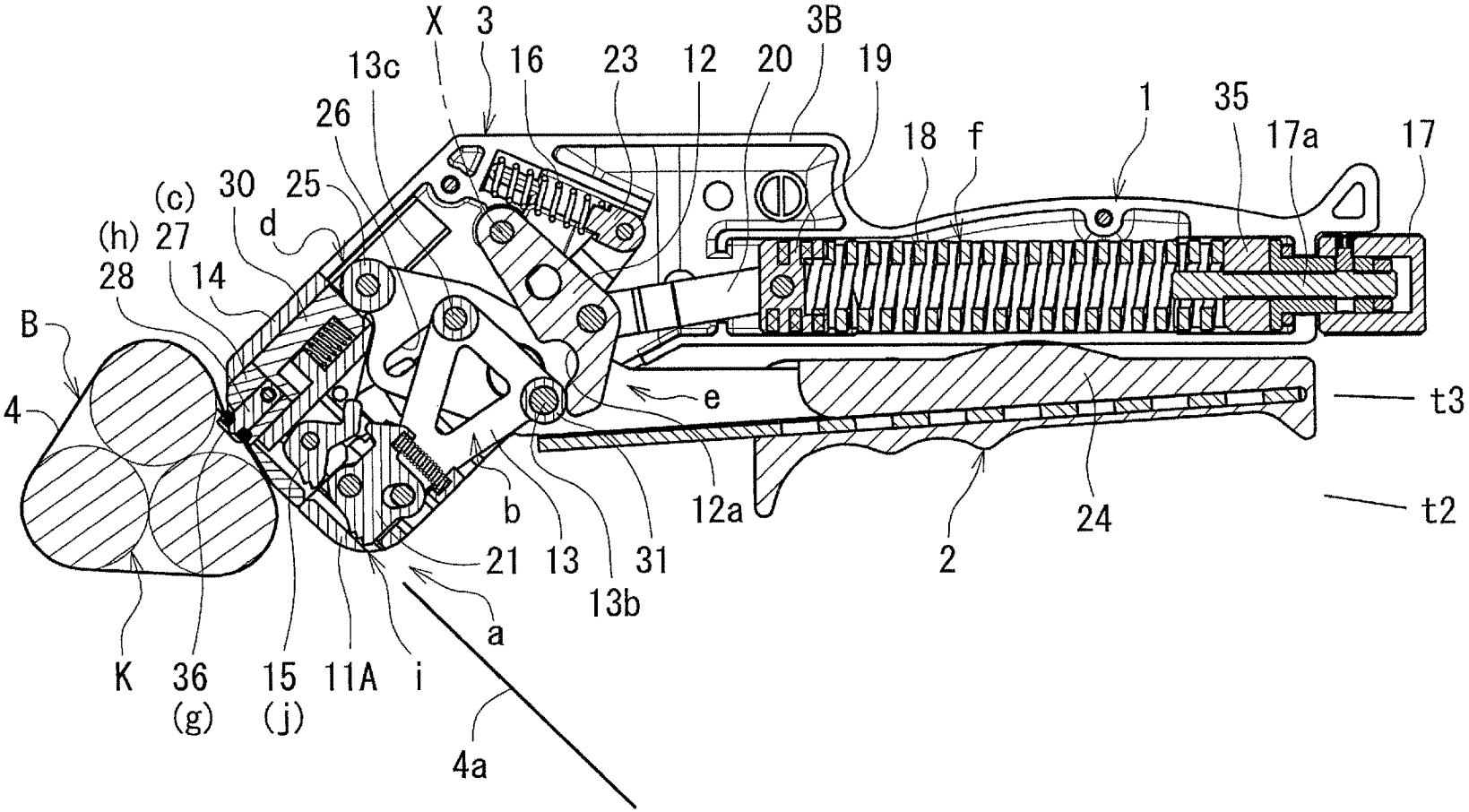
FIG. 12 is a functional view showing a state where, in the punch cutting step, the second lever is maximally swung to be located at a third position.

As shown in FIGS. 12 and 13, then, the holder 30, and the cutting blade 27 and punch body 28 which are integrated therewith are forcibly projected and moved against the elastic force of the return spring 29. In FIGS. 11, 13, and the like, the cut and raised claw 8 and the stopper 9 are not shown for the sake of simplicity.

First, the punch portion 28*a* at the tip end of the punch body 28 is passed over the substantially circular cutaway 5*c*, and then pushes the passed tie portion 4*c* which is the tie portion 4 located in the head portion 5, to cause plastic deformation (press molding), thereby producing an engagement state where the plastically deformed portion 4*b* enters the engagement hole 10 of the root tie portion 4*d*, and the escaping hole 5*b* [see FIG. 13(*b*)].

Moreover, the blade portion 27*a* at the tip end of the cutting blade 27 press cuts the projection tie portion 4*a* at a position proximity to the head portion 5.

At this time, the both sides of the projection tie portion 4*a* are supported by the head portion 5 and the guide wall 6*a*. The place which is in a so-called both-ends supported state is press cut by the blade portion 27*a*, and an extra projection tie portion 4*a* is cut away surely and smoothly.

As shown in FIG. 13(*b*), in a state where the cutting blade 27 is mostly projected, furthermore, the tie portion 4 which is located on the to-be-bound object side of the projection tie portion 4*a* that has been cut is in a state where it is slightly pushed by the blade portion 27*a* which has been used for cutting.

However, the pushed tie portion 4 is in a so-called cantilever state due to the head portion 5, and a tendency to bend toward the to-be-bound object side is originally provided by a tip-end wall 11A. Therefore, the tie portion is pushed so slightly that it receives no action from the blade portion 27*a*.

Only when the force reaches the preset tightening force, as described above, the second lever 2 is allowed to be moved from the second position t2 to the third position t3. In the punch cutting step due to the movement to the third position t3, the passed tie portion 4*c* and the root tie portion 4*d* are engaged by the plastically deformed portion 4*b* to fix the tie portion 4 in a loop-like state, and engagement (punch engagement) is performed also on the head portion 5. In addition, an extra projection tie portion 4*a* is cut away.

Since the state where the circular plastically deformed portion 4*b* is press inserted into the engagement hole 10 and the escaping hole 5*b* is obtained, because of the sure punch coupling, the prevention of slipping off of the tie portion 4 itself, and the integration of the tie portion and the head portion 5 are performed in one stroke, and the bundling state by the preset tightening force can be surely maintained.

After the projection tie portion 4*a* is cut, the restriction of the triangular link 13 by the engagement claw 21 is canceled. In accordance with return swinging of the second lever 2 to the first position t1, therefore, the tool is returned to the state (see FIG. 3) where the support roller 31 is again engaged into the tip-end recess 12*a*, and the tightening adjusting mechanism f effectively functions.

In the manual binding tool A, as shown in FIGS. 3, 4, 14, and the like, the tightening mechanism a is configured by having the base arm 11, the engagement claw 21, and the return spring 22. The tightening linkage mechanism b is configured by having the tension arm 12, the triangular link 13, and the engagement groove 26 which is fitted to the intermediate pin 13*c*.

The cutting linkage mechanism d is configured by having the cutter roller 25, the triangular link 13, the engagement groove 26, and the tension arm 12. The switching mechanism e is configured by having the tightening force adjusting spring 18, the tension bar 20, the tension arm 12, and the triangular link 13.

The tightening linkage mechanism b links the both levers 1, 2 with the tightening mechanism a in the state where the projection tie portion 4*a* is pulled by relatively approaching swinging in the range within the predetermined relative angle of the first lever 1 and the second lever 2, i.e., the angle between the first position t1 and the second position t2 about the axis P (the tightening step). The cutting linkage mechanism d links the both levers 1, 2 with the cutting mechanism c in the state where the projection tie portion 4*a* is cut by relatively approaching swinging of the first lever 1 and the second lever 2 in the predetermined relative angle, i.e., beyond the second position t2 (the punch cutting step).

Then, the switching mechanism e functions so as to, when the pulling force of the projection tie portion 4*a* due to the tightening mechanism a is smaller than the preset value, set the tightening state where the tightening linkage mechanism b is caused to operate, and the cutting linkage mechanism d is caused not to operate, and, when the pulling force of the projection tie portion 4*a* due to the tightening mechanism a reaches the preset value, cause the tightening linkage mechanism b not to operate, and the cutting linkage mechanism d to operate.

As shown in FIG. 14 and the like, the cutting mechanism c has the configuration including the pushing mechanism h which pushes and deforms the tie portion 4, i.e., the passed tie portion 4*c* that is located in the head portion 5 as a result that the tie portion 4 is wound around the to-be-bound object K and then inserted from the pointed tip end 7 into the head portion 5, by the punch body 28, and which causes the deformed portion (plastically deformed portion) 4*b* to be engaged into the circular engagement hole 10 formed in the root tie portion 4*d*.

Because of the tightening mechanism a (specifically, because there is a play between a timing when the triangular link 13 and engagement claw 21 which include the fitting between the tip-end pin 13*a* and the long hole 21*a* are pushed by the second lever 2, and that when the tip end portion 21*c* starts to push the tip-end inner wall 11*b* through) the projection tie portion 4*a*), the tool is configured in the state where, in accordance with movement in which the first lever 1 and the second lever 2 are relatively approaching swung by griping the both levers 1, 2 from the waiting state (state shown in FIG. 3) where the both levers 1, 2 are mostly openly swung, the projection tie portion 4*a* is gripped by the pulling portion i and then pulled by the pulling portion i.

When the projection tie portion 4*a* is not gripped by the pulling portion i (at least in the return swinging step), in addition, the return preventing mechanism j functions so as to block a return movement of the projection tie portion 4*a* to the head portion 5. Therefore, the tool is configured so that, just at the moment when the force applied by the fingers is released and the gripping of the first and second levers 1, 2 is cancelled, the return preventing mechanism j operates, and hence an unexpected return movement of the tightened tie portion 4 does not occur.

As described above, according to the manual binding tool A of Embodiment 1, in a state where the substantially whole length of right and left end portions of the head portion 5 is housed and supported by the pair of right and left hook portions 36, 36 of the tie holding portion g, the pushing mechanism h is operated so that the pushing force of the punch body 28 is caused to operate, the passed tie portion 4*c* located in the head portion 5 is forcibly deformed, and the deformed portion 4*b* is engaged into the engagement hole 10 of the root tie portion 4*d*.

Namely, the passed tie portion 4*c* which receives the force of the punch body 28 is substantially in a both-ends supported state in both the longitudinal and transverse directions. Therefore, the force is used effectively and efficiently for forming the plastically deformed portion 4*b* without escaping, and the plastically deformed portion 4*b* can be surely pressed into the engagement hole 10 to be engaged therewith.

As a result, the manual binding tool A can be provided in which a mechanism for applying plastic deformation to the tie portion 4 located in the head portion 5 to forcibly cause the tie portions 4 to engage with each other is further improved, and which is therefore improved so that a disadvantage that the pushing force acting on the head portion 5 escapes is eliminated, plastic deformation can be performed in a firmly supported state, and slip-off prevention can be conducted more surely.

Because of the improved configuration of the tie holding portion g due to the right and left hook portions 36, 36, the restriction projection 37, and the like, in the state where the head portion 5 is supported by the tie holding portion g, the tie holding portion g and the punch body 28 are placed in a linked manner so that the engagement hole 10, the escaping hole 5*b*, and the substantially circular cutaway 5*c* are located on the projective movement locus p of the punch body 28.

According to the configuration, all the three components or the substantially circular cutaway 5*c*, the engagement hole 10, and the escaping hole 5*b* are set in a place scheduled to be punched by the punch body 28, simply by mounting the head portion 5 on the tie holding portion g. Consequently, the operation of the pushing mechanism h enables the plastically deformed portion 4*b* which is circular as viewed in the direction of the projective movement locus p, to be engaged smoothly and surely into the circular engagement hole 10 which is coaxial therewith.

Therefore, there is an advantage that the effect that more sure slip-off prevention due to the above-described sure punch engagement can be performed is further enhanced.

In the tie holding portion g, as shown in FIGS. 13 and 15, the structural improvements such as that the right and left hook portions 36, 36 are formed separately from each other to dispose a space portion therebetween are made, and hence the avoiding portion 39 is formed that avoids interference with the tip end portion 4*e* which projects while passing through the engagement hole 10 in the deformed portion 4*b* that is formed by the pushing mechanism h.

According to the configuration, the amount of projection of the plastically deformed portion 4*b* can be set to be larger than the thickness width of the head portion 5, in order that the engagement state of the plastically deformed portion 4*b* formed by the punch body 28, and the engagement hole 10 is made sure, and that the projection amount of the pointed tip end of the punch body 28 is increased to enable the tie portion 4 to be smoothly press molded (see FIG. 15). Moreover, the existence of the avoiding portion 39 provides advantages that, when the head portion 5 is mounted in the tie holding portion g, an interference with the cut and raised claw 8 and the stopper 9 can be avoided, and that the manner of attaching the head portion 5 to the tie holding portion g can be viewed. Irrespective of existence of the tip end portion 4*e*, therefore, the tie holding portion g can be made multi- and high-functional.

The cutting mechanism c is configured by having the cutting blade 27 which is projectively and retractively slidable with respect to the tie holding portion g, and the cutting blade 27 and the punch body 28 are separably integrated with each other. Therefore, the convenient manual binding tool A is realized in which a work of engaging and integrating the root tie portion 4*d* with the passed tie portion 4*c* by the pushing mechanism h, and a cutting work of cutting off an extra projection tie portion 4*a* by the cutting mechanism c are performed in one stroke.

There is a further advantage that the separation of the cutting blade 27 from the punch body 28 enables one of the specification including only the cutting mechanism c, that including only the pushing mechanism h, and that including the both mechanisms c, h to be selectively set.

According to the manual binding tool A of Embodiment 1, by the switching mechanism e, when the pulling force of the projection tie portion 4*a* is smaller than the preset value, the tightening state where only the tightening mechanism a is caused to operate is set, and, when the pulling force of the projection tie portion 4*a* reaches the preset value, the tool is automatically switched to the punch cutting state where only the pushing mechanism h and the cutting mechanism c are caused to operate. Without disposing a third lever, therefore, the tool is configured so that the series of binding works (tightening and punch cutting) on the binding tie B can be performed simply by performing gripping manipulation of the pair of levers 1, 2.

Even in either of the tightening and cutting steps, therefore, the state where the first and second levers 1, 2 are gripped can be maintained, and therefore it is possible to provide the manual binding tool A in which, without requiring transferring of a plurality of fingers, pulling manipulation and cutting manipulation can be performed simply by performing gripping manipulation of the pair of levers, so that the tool can further simplify a binding work, and is very easy to use.

Moreover, the tightening adjusting mechanism f enables the conditions for operating the switching mechanism e, i.e., the tightening force to be adjusted by a simple manipulation of rightward or leftward rotating the adjustment knob 17. Therefore, it is possible also to realize the manual binding tool A in which the tightening force of the binding tie B can be easily adjusted and set in accordance with the to-be-bound object K, and which is highly practically advantageous.

DESCRIPTION OF REFERENCE NUMERALS

4*a* projection tie portion
4*b* deformed portion
4*c* passed tie portion
4*d* root tie portion
4*e* tip end portion
5 head portion
10 engagement hole
27 cutting blade
28 punch body
39 avoiding portion
a tightening mechanism
c cutting mechanism
g tie holding portion
h pushing mechanism
j return preventing mechanism
p projective movement locus

The invention claimed is:

1. A manual binding tool used for a binding tie, the binding tie including a tie portion with an engagement hole and a head portion incorporated in the tie portion, the manual binding tool having:

a tie holding portion defining a pair of hook portions and a restriction projection located immediately adjacent to the pair of hook portions, wherein the head of the binding tie is received within and supported by the pair of hook portions and wherein an end edge of the head portion butts against the restriction projection when received in the pair of hook portions;

a tightening mechanism which includes a pulling portion for gripping a projection tie portion of the tie portion, the projection tie portion projecting through the head portion that is supported by the tie holding portion, and pulls the projection tie portion with respect to the head portion by using the pulling portion;

a return preventing mechanism that blocks a return movement of the projection tie portion with respect to the head portion that is supported by the tie holding portion; and a pushing mechanism which, in a state in which the head portion is supported by the tie holding portion, pushes and deforms a passed tie portion of the tie portion, the passed tie portion being located in the head portion, and causes a deformed portion to be engaged into the engagement hole formed in a root tie portion of the tie portion, the root tie portion being surrounded by the head portion, wherein the return preventing mechanism includes a chuck claw placed between the tie holding portion and the pulling portion, wherein the chuck claw is configured to contact the projection tie portion, and wherein a cutting mechanism that cuts the projection tie portion travels through the restriction projection while cutting the projection tie portion.

2. The manual binding tool according to claim 1, wherein the pushing mechanism has a punch body that is projectively and retroactively movable, and that is used for pushing and deforming the projection tie portion, and, in a state in which the head portion is supported by the tie holding portion, the tie holding portion and the punch body are placed in a linked manner so that the engagement hole is located on a projective movement locus of the punch body.

3. The manual binding tool according to claim 2, wherein an avoiding portion is formed in the tie holding portion, the avoiding portion avoiding an interference with a tip end portion of the deformed portion which projects while passing through the engagement hole in the deformed portion that is formed by the pushing mechanism.

4. The manual binding tool according to claim 1, wherein an avoiding portion is formed between the pair of hook portions, the avoiding portion avoiding an interference with a tip end portion of the deformed portion which projects while passing through the engagement hole in the deformed portion that is formed by the pushing mechanism.

5. The manual binding tool according to claim 1, wherein the cutting mechanism is configured by having a cutting blade that is projectively and retractively slidable with respect to the tie holding portion, and the cutting blade and the punch body are separably integrated with each other.

* * * * *